US005479802A

United States Patent [19]

Miller

[11] Patent Number: 5,479,802

[45] Date of Patent: Jan. 2, 1996

[54] METHOD OF INSTALLING A COMBINATION LOCK DEADBOLT ASSEMBLY AND A KIT THEREFOR

[76] Inventor: J. Clayton Miller, 5085 Danville Rd., Nicholasville, Ky. 40356

[21] Appl. No.: 230,948

[22] Filed: Apr. 21, 1994

[51] Int. Cl.[6] ..... E05B 9/06

[52] U.S. Cl. ..... 70/443; 29/464; 29/525.1; 70/370; 70/451; 70/466; 408/1 R; 408/115 R; 408/241 B

[58] Field of Search ..... 70/370, 451, 466, 70/442, 443, 465; 29/525.1, 464; 408/1 R, 72 B, 241 B, 115 R, 115 B

[56] References Cited

U.S. PATENT DOCUMENTS

| | | | |
|---|---|---|---|
| 1,579,126 | 3/1926 | Maxwell | 70/370 |
| 1,791,029 | 2/1931 | Hurd | 70/451 |
| 1,831,813 | 11/1931 | Levedahl | 408/241 B |
| 3,899,907 | 8/1975 | Prahl | 70/370 |
| 4,351,170 | 9/1982 | Clompus | 70/371 X |
| 4,530,223 | 7/1985 | Oliver | 70/417 |
| 4,688,409 | 8/1987 | Oliver et al. | 70/417 |
| 4,708,007 | 11/1987 | Stoia | 70/451 |
| 4,967,577 | 11/1990 | Gartner et al. | 70/303 A X |
| 5,092,144 | 3/1992 | Fleming et al. | 70/462 X |
| 5,220,816 | 6/1993 | Fish et al. | 70/466 X |
| 5,257,519 | 11/1993 | Miller, III | 70/443 X |

FOREIGN PATENT DOCUMENTS

| | | | |
|---|---|---|---|
| 2623840 | 6/1989 | France | 70/370 |
| 416576 | 7/1925 | Germany | 408/241 B |
| 1553509 | 10/1969 | Germany | 70/451 |
| 2245643 | 1/1992 | United Kingdom | 70/370 |

*Primary Examiner*—Lloyd A. Gall
*Attorney, Agent, or Firm*—Lowe, Price, LeBlanc & Becker

[57] ABSTRACT

A method of installing a combination lock deadbolt assembly includes the steps of providing a combination lock deadbolt assembly for mounting on a door surface in combination with a drill resistant hard plate. The hard plate, mounted on the outer door surface, includes legs extending through the door for attachment to the deadbolt assembly. A drill guide is provided having a tapered outer surface which corresponds to tapered openings in the combination lock deadbolt assembly. In use, the tapered drill guide is inserted into the openings in the deadbolt followed by insertion of a drill bit which drills holes through the door. After drilling each hole, the larger holes are drilled to facilitate attachment leg insertion into the door. The deadbolt can then be mounted to the door surface and to the drill resistant hard plate. A combination dial lock can then be mounted in the deadbolt assembly. A kit for combination lock installation includes the deadbolt assembly, the tapered drill guide and the drill resistant hard plate.

12 Claims, 3 Drawing Sheets

METHOD OF INSTALLING A COMBINATION LOCK DEADBOLT ASSEMBLY AND A KIT THEREFOR

FIELD OF THE INVENTION

The present invention is directed to a method of installing a combination lock deadbolt assembly and an installation kit and, in particular, to the utilization of a tapered drill guide for deadbolt assembly installation.

BACKGROUND ART

In the prior art, various jigs or templates have been proposed to facilitate the attachment of locking devices for security purposes.

U.S. Pat. No. 5,116,170 to Palmer et al. discloses a door preparation drill jig useful to prepare a door to receive a door lock set. The jig has a cylindrical body which fits snugly into a main bore of a door. When mounted in the main door, mounting holes can be drilled using a drill bit and drill guides extending from the door preparation drill jig.

U.S. Pat. No. 5,114,285 to Brydon discloses a three-sided drilling template for a door. The drilling template includes a plurality of through guide holes located along sides thereof for marking the centers of mounting holes for mounting of hardware such as door locks and knobs.

U.S. Pat. No. 4,280,776 to Chaconas et al. discloses a drill guide for use during the installation of lock sets in doors. The drill guide has a body through which an aperture extends for drilling of pilot holes for lock set installation.

In the prior art, it is also known to install combination locks in doors using a combination lock deadbolt assembly which includes an automatic deadbolt holdback feature. An example of this type of a deadbolt assembly is a Lockmasters LM-5100, manufactured in Nicholasville, Ky.

Typically, these types of deadbolt assemblies are mounted on the inside surface of a door with a drill resistant hard plate mounted adjacent thereto. However, since the drill resistant plate is mounted to the deadbolt, openings drilled through the door must be accurately located to avoid installation difficulties.

The use of templates or other marking utensils has not provided an accurate way to install these types of deadbolt assemblies. When using a template to make a drilling hole, the drill bit may tilt or angle with respect to the door surface or holes formed using the template may not align with openings in the lock hardware.

In view of these deficiencies, a need has developed to provide an improved method for installing these types of deadbolt assemblies in conjunction with combination locks.

In response to this need, the present invention provides a method for installing combination lock deadbolt assemblies using a tapered drill guide which interfaces with tapered bores in the deadbolt assembly to accurately locate drilling holes for deadbolt installation.

SUMMARY OF THE INVENTION

The present invention comprises a method of installing a combination lock deadbolt assembly on a door. The method includes the steps of providing a combination lock deadbolt assembly including a housing sized to receive a combination lock. The housing includes at least a pair of sidewalls connected by a base member, each sidewall including at least one tapered bore therein. After applying the housing to an inside surface of a door for mounting, a drill guide is sequentially inserted into each one of the tapered bores in the housing. The drill guide has an outer surface taper which corresponds to the taper of the bores in the housing to provide a snug fit. Following insertion of the drill guide into the tapered bore, a drill bit is inserted into the drill guide to drill holes through the door. The drill guide, sequentially placed in each of the tapered bores in the housing, facilitates drilling holes through the door for the deadbolt installation.

Once the holes are drilled through the door, a drill resistant plate can be mounted to the outside surface of the door. The drill resistant plate has a plurality of attachment legs which extend from a rear face thereof. The attachment legs extend through the door via holes drilled through the outer side of a hollow door or partially through a solid core door. The attachment legs are secured to the base member of the deadbolt assembly by fasteners inserted through the tapered bores of the deadbolt sidewalls.

In another aspect of the invention, a combination lock deadbolt assembly installation kit includes the combination lock deadbolt assembly, the drill resistant plate having a plurality of attachment legs extending from a rear face thereof and at least one tapered drill guide sized to correspond to the tapered bores in the sidewalls of the deadbolt assembly housing.

BRIEF DESCRIPTION OF THE DRAWINGS

Reference is now made to the drawings accompanying the invention wherein.

DESCRIPTION OF THE PREFERRED EMBODIMENTS

Figure 1:
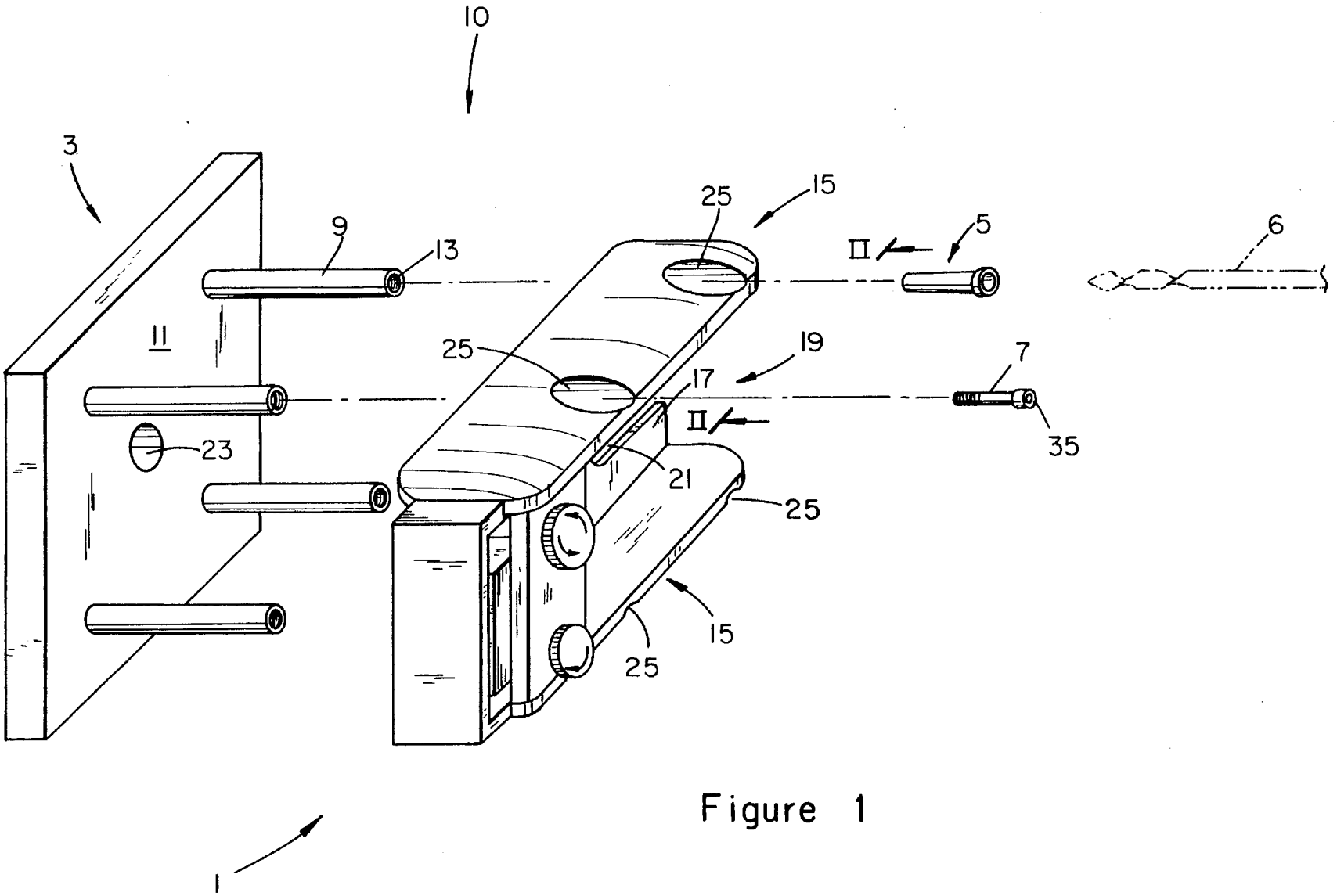
FIG. 1 is a perspective view of the kit components of the present invention.

With reference to FIG. 1, the present invention is generally designated by, the reference numeral 10 and is seen to include a combination lock deadbolt 1, a drill resistant plate 3, a tapered drill guide 5 and fasteners 7 (one shown) for securing the drill resistant plate 3 to the combination lock deadbolt 1.

The drill resistant plate 3 includes a plurality of attachment legs 9 extending from the plate rear face 11. Each of the attachment legs 9 terminate in a threaded opening 13. The attachment legs 9 of the drill resistant plate 3 can be secured to the plate in any conventional fashion including welding, a threaded mount or the like.

Although only one fastener 7 is depicted in FIG. 1, a fastener is provided for each of the threaded openings 13 of the drill resistant plate 3 (four in total).

The combination lock deadbolt includes a pair of sidewalls 15 joined by a base member 17. The sidewalls 15 and base member 17 form a recess or chamber which is sized to receive a combination lock body (not shown). The base member 17 has a slot 21 therein which receives the shaft of the combination dial lock. The drill resistant plate 3 has a bore 23 therethrough to receive the free end of the combination dial shaft.

The sidewalls 15 include bores 25 therethrough. As described hereinafter, the bores 25 include a tapered portion which corresponds to the outer surface taper of the drill guide 5.

Still with reference to FIG. 1, according to the inventive method, the deadbolt 1 is temporarily secured to a door (not shown) by any conventional means such as tape, clamps or the like. The tapered drill guide 5 is inserted in one of the bores 25 followed by insertion of a drill bit 6 therein. The drill bit 6 is used to drill entirely through the door while the deadbolt 1 remains mounted to the door surface.

The tapered drill guide 5 is then sequentially inserted into each of the bores 25 for hole drilling. The tapered drill guide maintains the drill bit generally perpendicular to the door surface to provide accurate alignment of the holes drilled in a door, especially if the door is a hollow metal door.

Once the holes are drilled through the door, a second set of larger holes are made in the door outer surface, as described below. The drill attachment legs 9 of the drill resistant plate are then inserted into the door. The fasteners 7 can then be inserted into the bores 25 to sandwich the door between the drill resistant plate 3 and deadbolt 1.

A combination lock can then be mounted to the door using the drill resistant plate shaft opening 23 and combination lock recess 19 and slot 21 of the deadbolt 1.

Figure 2:
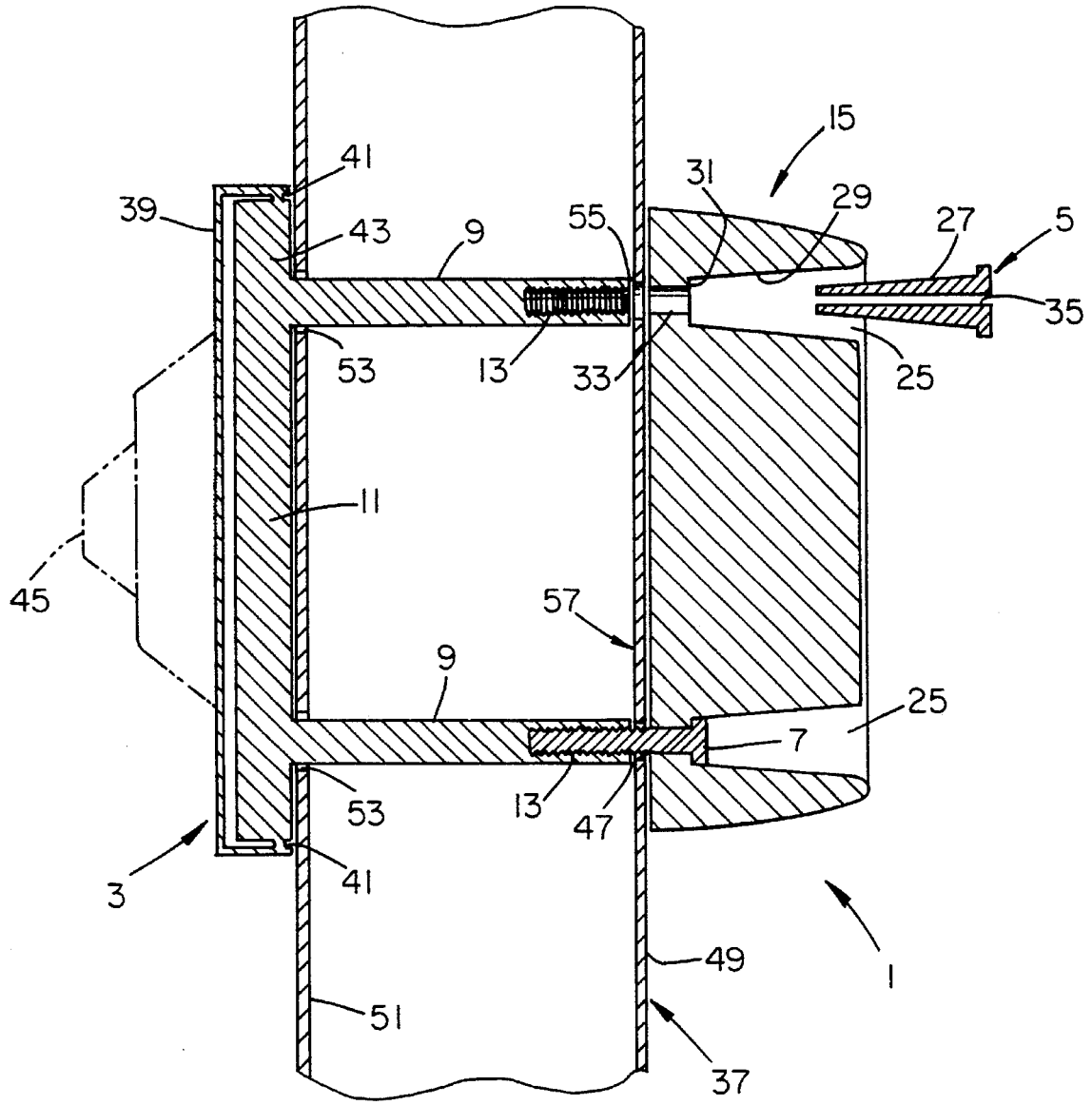
FIG. 2 is a sectional view of the components depicted in FIG. 1 along the line II—II mounted on a hollow door.

With reference now to FIG. 2, the deadbolt 1 and drill resistant plate 3 are shown sandwiching a hollow door 37. The drill resistant plate 3 preferably includes a decorative shell 39 spot welded at reference numerals 41 to the drill resistant material 43. Alternatively, the drill resistant material 43 alone can be utilized for attachment to the deadbolt 1.

FIG. 2 also more clearly shows the taper 27 of the drill guide 5 and its correspondence to the taper 29 in the bores 25.

Each bore 25 includes a step 31 which separates the taper 29 from a reduced diameter portion 33. In use, the drill guide 5 is inserted into the bore 25 to seat against the step 31. The cylindrical bore 35 in the tapered drill guide 5 is sized to align with the reduced diameter portion 33 of the bore 25. With this size correspondence, a drill bit entering the drill guide 5 is aligned with the reduced diameter portion 33 and cylindrical bore 35 for drilling through the door 37. The correspondence between the taper 27 of the drill guide 5 and taper 29 of the bore 25 maintain the drill bit 6 in a generally perpendicular alignment with the door surface. This alignment permits drilling a hole through the door 37, the axis thereof remaining aligned with the axis of the bore 25. In addition, the axes of each hole drilled through the door are generally mutually parallel as a result of using the drill guide 5 in each of the deadbolt bores 25.

When using a hollow metal door 37 for combination lock installation, a through hole 47 of a diameter corresponding generally to the drill bit diameter is made in inner surface door member 49 and outer door member 51.

After this first diameter hole is drilled, a second and larger diameter hole 53 is drilled in the outer surface door member 51. The larger diameter hole 53 corresponds in size to the attachment leg 9 of the drill resistant plate 3.

Still with reference to FIG. 2, the attachment legs 9 can then be inserted through the holes 53 such that the distal end 55 of each of the legs 9 abuts the surface 57 of the inner door member 49.

The drill resistant plate can then be secured by inserting the fasteners 7 into the bores 25 and threadably attaching them to the threaded openings 13 of the legs.

The abutment of the distal ends 55 of the attachment legs 9 against the surface 57 of the inner door member 49 provides an additional security feature to prevent surreptitious entry into the areas secured by the combination lock. That is, if a person seeking entry into the secured area would remove the drill resistant plate by chiseling through the point of attachment between the hard plate 43 and legs 9, the legs 9 would still function as a nut for fasteners 7. This nut action retains the deadbolt on the door member 49 even if the hard plate 43 is removed.

Using the tapered drill guide 5 assures a precise alignment between the axis of each bore 25 and a corresponding attachment leg 9 of the drill resistant plate. Consequently, the deadbolt 1 can be installed on a door surface in combination with the drill resistant plate 3 without the need for a template or other prior art devices.

With reference to FIGS. 1 and 2, once the deadbolt 1 is installed on a door 37 in conjunction with the drill resistant plate 3, a combination lock can be mounted in the recess 19 of the deadbolt 1. The combination lock dial shaft would extend through the door 37 and the through hole 23 of the drill resistant plate 3. A combination dial 45 can then be mounted to the combination dial shaft adjacent the drill resistant plate 3 as shown in FIG. 2.

Figure 3:
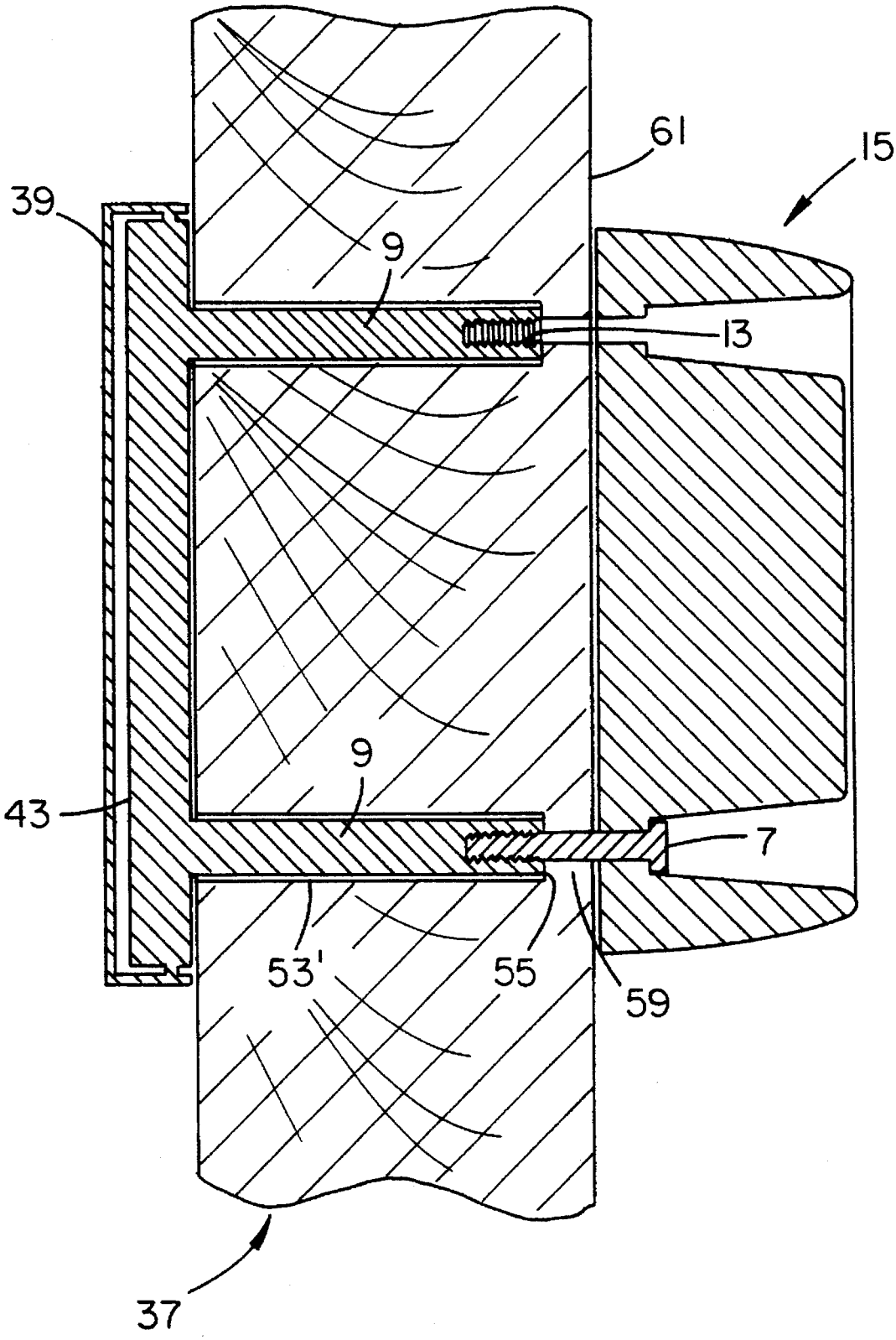
FIG. 3 is a sectional view similar to FIG. 2 using a solid wood door.

An alternative installation is shown using a solid wood door 37 in FIG. 3. In this embodiment, the second and larger diameter holes 53' are drilled to a length less than the door thickness to leave a portion 59 between the distal ends 55 of the attachment leg 9 and the inner door surface 61. In this case, if the attachment leg is chiseled away from the drill resistant plate 43, the attachment leg 9 still retains its nut function with fastener 7 due to the presence of the solid core wood portion 59.

The drill resistant hard plate material can be any known type having drill resistant properties. For example, a carbide-containing plate or carbide coated plate can be utilized such as that supplied by Lockmasters, Inc. of Nicholasville, Ky.

As such, an invention has been disclosed in terms of preferred embodiments thereof which fulfill each and every one of the objects of the present invention as set forth hereinabove and provide a new and improved method for installing a combination lock and an installation kit.

Of course, various changes, modifications and alterations from the teaching of the present invention may be contemplated by those skilled in the art without departing from the intended spirit and scope thereof. Accordingly, it is intended that the present invention only be limited by the terms of the appended claims.

I claim:

1. A method of installing a combination lock deadbolt assembly on a door comprising the steps of:

a) providing a housing for a combination lock, said housing formed by at least a pair of sidewalls connected by a base member, each sidewall including at least one elongated tapered bore therethrough, a taper of each said at least one elongated tapered bore extending from a opening to a step in said at least one elongated tapered bore;

b) applying said housing to one surface of said door;

c) inserting a drill guide having a cylindrical drill bit bore into said elongated tapered bore, said drill guide having an outer surface taper extending between one end of said drill guide and a drill guide lip positioned at an end opposite said one end, said outer surface taper corresponding to the taper of each of said tapered bores;

d) inserting a drill bit into said drill guide to drill a hole through said door; and e) repeating steps (c) and (d) for each tapered bore in said housing to facilitate mounting said housing to said door.

2. The method of claim 1 further comprising:

providing a drill resistant hard plate having a plurality of attachment legs extending from a rear face thereof, said attachment legs located on said drill resistant hard plate to correspond to said tapered bores in said housing;

drilling openings in said door corresponding in size to said attachment legs;

inserting said attachment legs into said openings; and fastening said drill resistant plate and said housing together.

3. The method of claim 2 further comprising mounting a combination lock mechanism in said housing.

4. The method of claim 2 further comprising:

selecting a hollow core door comprising inner and outer members;

applying said housing to said inner member; and drilling said openings through said outer member, said attachment legs being sized in length so that a portion of said inner member is positioned between distal ends of said attachment legs and said housing.

5. The method of claim 2 further comprising:

selecting a solid core door having said one surface and an opposite surface; and drilling said openings in said solid core door from said opposite surface such that a portion of said solid door is positioned between distal ends of said attachment legs and said housing.

6. A kit for installing a combination lock deadbolt assembly on a door surface, comprising:

a) a deadbolt housing having a pair of sidewalls connected by a base member, said sidewalls and base member forming a recess to receive a combination lock, said sidewalls having a plurality of through openings, each through opening including an elongated tapered portion, said elongated tapered portion extending from an open end of said through opening to a step at an end opposite said open end;

b) a drill guide having a cylindrical drill bit bore and a tapered outer surface portion extending between one end of said drill guide and drill guide lip positioned at an end opposite said one end, said tapered outer surface portion sized to correspond to said elongated tapered portion of said through openings; and c) a drill resistant hard plate having attachment legs extending from a rear face thereof, said attachment legs sized in length less than a thickness of said door and located on said rear face to correspond to the location of said through openings in said sidewalls for attachment to said deadbolt housing.

7. The kit of claim 6 wherein said drill resistant hard plate and said base member having openings therethrough to receive a shaft of said combination lock.

8. The kit of claim 6 wherein said drill resistant hard plate includes a decorative covering.

9. The kit of claim 6 wherein each said attachment leg has a threaded opening in an end thereof for fastening to said deadbolt housing.

10. The kit of claim 6 further comprising fasteners sized to extend through said through openings of said sidewalls and attach to ends of said attachment legs.

11. The kit of claim 10 wherein said drill resistant hard plate includes a decorative covering.

12. The kit of claim 10 wherein each said attachment leg has a threaded opening in an end thereof for fastening to said deadbolt housing.

* * * * *